US009334683B1

(12) United States Patent
Kunz

(10) Patent No.: US 9,334,683 B1
(45) Date of Patent: May 10, 2016

(54) SYSTEM AND METHOD FOR PROVIDING A MORE RELIABLE INTERCONNECTION BETWEEN A SPRING AND A BRAKE SHOE IN THE COUNTERBALANCE SYSTEM OF A TILT-IN WINDOW

(71) Applicant: John R. Kunz, Douglassville, PA (US)

(72) Inventor: John R. Kunz, Douglassville, PA (US)

(73) Assignee: John Evans' Sons, Inc., Lansdale, PA (US)

( * ) Notice: Subject to any disclaimer, the term of this patent is extended or adjusted under 35 U.S.C. 154(b) by 0 days.

(21) Appl. No.: 13/655,416

(22) Filed: Oct. 18, 2012

(51) Int. Cl.
*E05D 15/22* (2006.01)

(52) U.S. Cl.
CPC ..... *E05D 15/22* (2013.01)

(58) Field of Classification Search
CPC ..... E05D 15/22
USPC ..... 49/176, 181, 445–447, 453; 16/193, 16/197
See application file for complete search history.

(56) References Cited

U.S. PATENT DOCUMENTS 4,718,194 A * 1/1988 FitzGibbon et al. ..... 49/181
4,914,861 A * 4/1990 May ..... 49/181
5,027,557 A * 7/1991 May ..... 49/181
5,210,976 A * 5/1993 Cripps ..... 49/181
5,232,208 A 8/1993 Braid et al.
5,371,971 A * 12/1994 Prete ..... 49/380
6,041,475 A * 3/2000 Nidelkoff ..... 16/193
6,151,832 A * 11/2000 Opielski et al. ..... 49/181
6,553,620 B2 * 4/2003 Guillemet et al. ..... 16/197
6,983,513 B2 * 1/2006 Pettit ..... 16/197
7,587,787 B2 * 9/2009 Pettit ..... 16/197
7,726,073 B2 * 6/2010 Ifko ..... 49/181
2004/0163209 A1 * 8/2004 Pettit ..... 16/197
2006/0230682 A1 * 10/2006 Ifko ..... 49/181

* cited by examiner

*Primary Examiner* — Katherine Mitchell
*Assistant Examiner* — Scott Denion
(74) *Attorney, Agent, or Firm* — LaMorte & Associates, P.C.

(57) ABSTRACT

An assembly of components that are use in a counterbalance system for a tilt-in window. A coil spring of wound ribbon is provided that has a shaped head. A brake shoe housing is provided that connects to the coil spring in such a manner that fatigue stresses are reduced in the coil spring as the tilt-in window is operated. The brake shoe housing has a receptacle slot formed into one of its side surfaces. An open relief is formed immediately above the receptacle slot. The open relief abuts against and supports the ribbon of the coil spring just behind the shaped head. By engaging the shaped head of the coil spring and supporting the coil spring adjacent to the shaped head, stresses experienced by the shaped head are greatly reduced. The result is a coil spring that has a much longer service life.

11 Claims, 7 Drawing Sheets

SYSTEM AND METHOD FOR PROVIDING A MORE RELIABLE INTERCONNECTION BETWEEN A SPRING AND A BRAKE SHOE IN THE COUNTERBALANCE SYSTEM OF A TILT-IN WINDOW

BACKGROUND OF THE INVENTION

1. Field of the Invention

In general, the present invention relates to counterbalance systems for windows that prevent open window sashes from moving under the force of their own weight. More particularly, the present invention system relates to the structure of the brake shoe component of counterbalance systems for tilt-in windows and the manner in which springs connects to the brake shoe.

2. Description of the Prior Art

There are many types and styles of windows. One of the most common types of window is the double-hung window. Double-hung windows are the window of choice for most home construction applications. A double-hung window consists of an upper window sash and a lower window sash. Either the upper window sash or the lower window sash can be selectively opened and closed by a person sliding the sash up and down within the window frame.

A popular variation of the double-hung window is the tilt-in double-hung window. Tilt-in double-hung windows have sashes that can be selectively moved up and down. Additionally, the sashes can be selectively tilted into the home so that the exterior of the sashes can be cleaned from within the home.

The sash of a double-hung window has a weight that depends upon the materials used to make the window sash and the size of the window sash. Since the sashes of a double-hung window are free to move up and down within the frame of a window, some counterbalancing system must be used to prevent the window sashes from constantly moving to the bottom of the window frame under the force of their own weight.

For many years, counterbalance weights were hung next to the window frames in weight wells. The weights were attached to window sashes using a string or chain that passed over a pulley at the top of the window frame. The weights counterbalanced the weight of the window sashes. As such, when the sashes were moved in the window frame, they had a neutral weight and friction would hold them in place.

The use of weight wells, however, prevents insulation from being packed tightly around a window frame. Furthermore, the use of counterbalance weights on chains or strings cannot be adapted well to tilt-in double-hung windows. Accordingly, as tilt-in windows were being developed, alternative counterbalance systems were developed that were contained within the confines of the window frame and did not interfere with the tilt action of the tilt-in windows.

Modern tilt-in double-hung windows are primarily manufactured in one of two ways. There are vinyl frame windows and wooden frame windows. In the window manufacturing industry, different types of counterbalance systems are traditionally used for vinyl frame windows and for wooden frame windows. The present invention is mainly concerned with the structure of vinyl frame windows. As such, the prior art concerning vinyl frame windows is herein addressed.

Vinyl frame, tilt-in, double-hung windows are typically manufactured with guide tracks along the inside of the window frame. Brake shoe assemblies, commonly known as "shoes" in the window industry, are placed in the guide tracks and ride up and down within the guide tracks. Each sash of the window has two tilt pins or tilt posts that extend into the shoes and cause the shoes to ride up and down in the guide tracks as the window sashes are opened or closed.

The shoes contain a brake mechanism that is activated by the tilt post of the window sash when the window sash is tilted inwardly away from the window frame. The shoe therefore locks the tilt post in place and prevents the base of the sash from moving up or down in the window frame once the sash is tilted open. Furthermore, the brake shoes are attached to curl springs inside the guide tracks of the window assembly. Curl springs are constant force coil springs, made from wound length of metal ribbon, that supply the counterbalance force needed to suspend the weight of the window sash.

Small tilt-in windows have small relatively light window sashes. Such small sashes may only require a single coil spring on either side of the window sash to generate the required counterbalance forces. However, due to the space restrictions present in modern tilt-in window assemblies, larger springs cannot be used for heavier window sashes. Rather, multiple smaller coil springs are ganged together to provide the needed counterbalance force. A large tilt-in window sash may have up to eight coil springs to provide the needed counterbalance force. Counterbalance systems that use ganged assemblies of coil springs are exemplified by U.S. Pat. No. 5,232,208 to Braid, entitled Springs For Sash Frame Tensioning Arrangements.

The metal ribbons of coil springs in a window counterbalance system usually experience tension as they support the weight of the window sash. However, this is not always the case. When a window sash is rapidly opened, the upward speed of the window sash may exceed the recoil speed of the counterbalance springs. In such a situation, the metal ribbons of the coil springs may experience a brief period of compression. The ribbons of coil springs are typically uniform in width, except for the free ends of the spring ribbon. The free ends of the spring ribbon are often stamped and shaped so that the end of the spring can engage the structure of the brake shoe. Since the areas near the ends of the spring ribbons are reduced in width, the repeating tension and compression stresses tend to concentrate in these reduced areas. The cycles of tension forces and compressive forces cause the metal ribbon of the coil spring to fatigue. Eventually, the fatigue forces can cause the coil spring to break, thereby disconnecting the coil spring from the brake shoe. This causes the overall counterbalance system to fail.

A need therefore exists in the field of vinyl, tilt-in, double-hung windows, for a counterbalance system with a brake shoe that can attach to a coil spring in such a way that the structure of the brake shoe prevents fatigue stresses from compromising the coil spring. This need is met by the present invention as described and claimed below.

SUMMARY OF THE INVENTION

The present invention is an assembly of components that are use in a counterbalance system for a tilt-in window. A coil spring of wound ribbon is provided that has a free end that terminates with a shaped head. A brake shoe housing is provided that connects to the coil spring in such a manner that fatigue stresses are reduced in the coil spring as the tilt-in window is repeatedly opened and closed.

The brake shoe housing has a receptacle slot formed into one of its side surfaces. The receptacle slot is formed low on the side of the brake shoe housing. An open relief is formed immediately above the receptacle slot. The open relief abuts against and supports the ribbon of the coil spring just behind the shaped head. By engaging the shaped head of the coil spring and supporting the coil spring adjacent to the shaped head, stresses experienced by the shaped head are greatly reduced. The result is a coil spring that has a much longer service life. Furthermore, the connection between the coil spring and the housing also assist in preventing excessive cocking of the brake shoe housing. This prevents wear of the brake shoe housing and increases its operational life.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The claimed features of the present invention brake shoe can be incorporated into many window counterbalance designs. However, the embodiment illustrated shows only one exemplary embodiment of the counterbalance system for the purpose of disclosure. The embodiment illustrated is selected in order to set forth one of the best modes contemplated for the invention. The illustrated embodiment, however, is merely exemplary and should not be considered a limitation when interpreting the scope of the appended claims.

Figure 1:
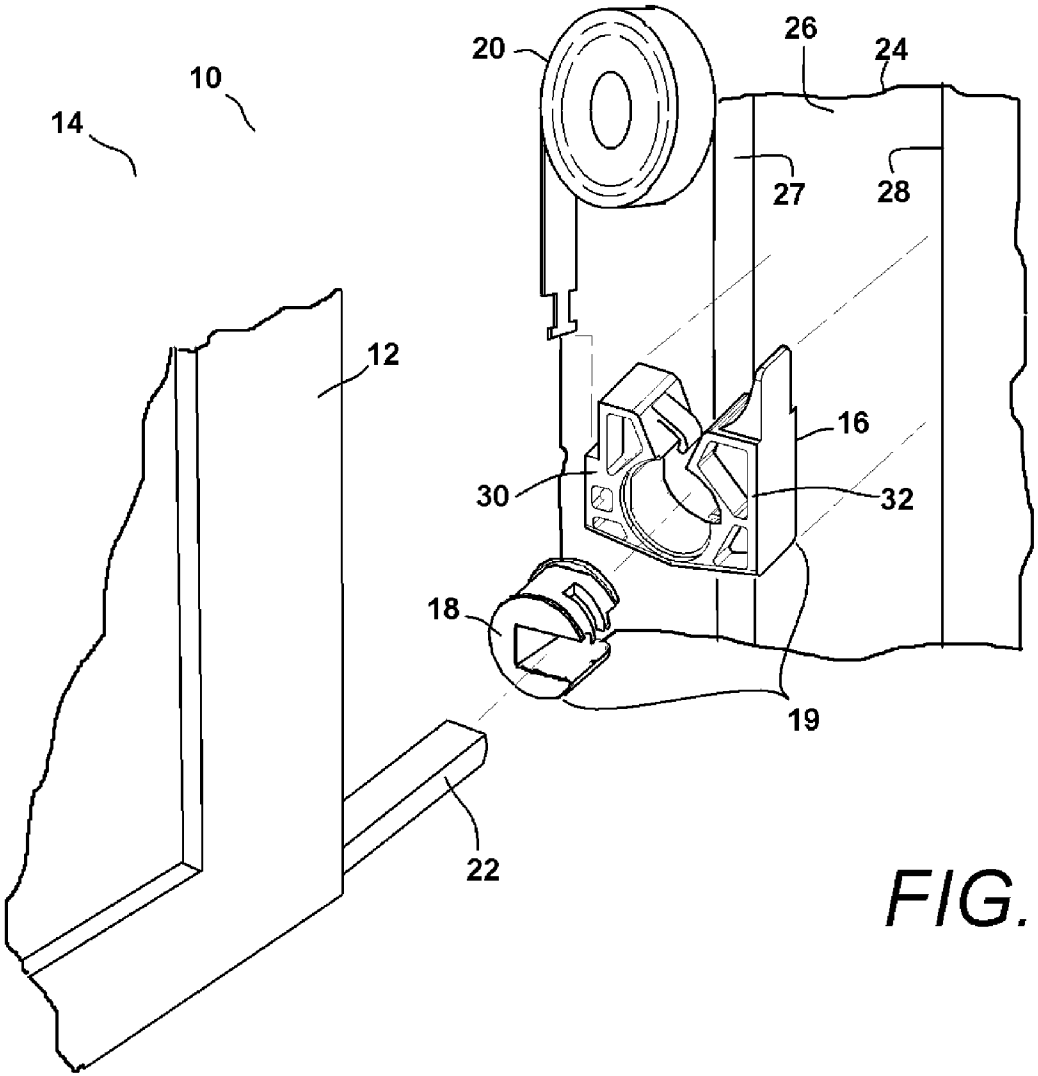
FIG. 1 is an exploded perspective view of a section of a tilt-in window assembly containing a counterbalance system in accordance with the present invention.
Figure 2:
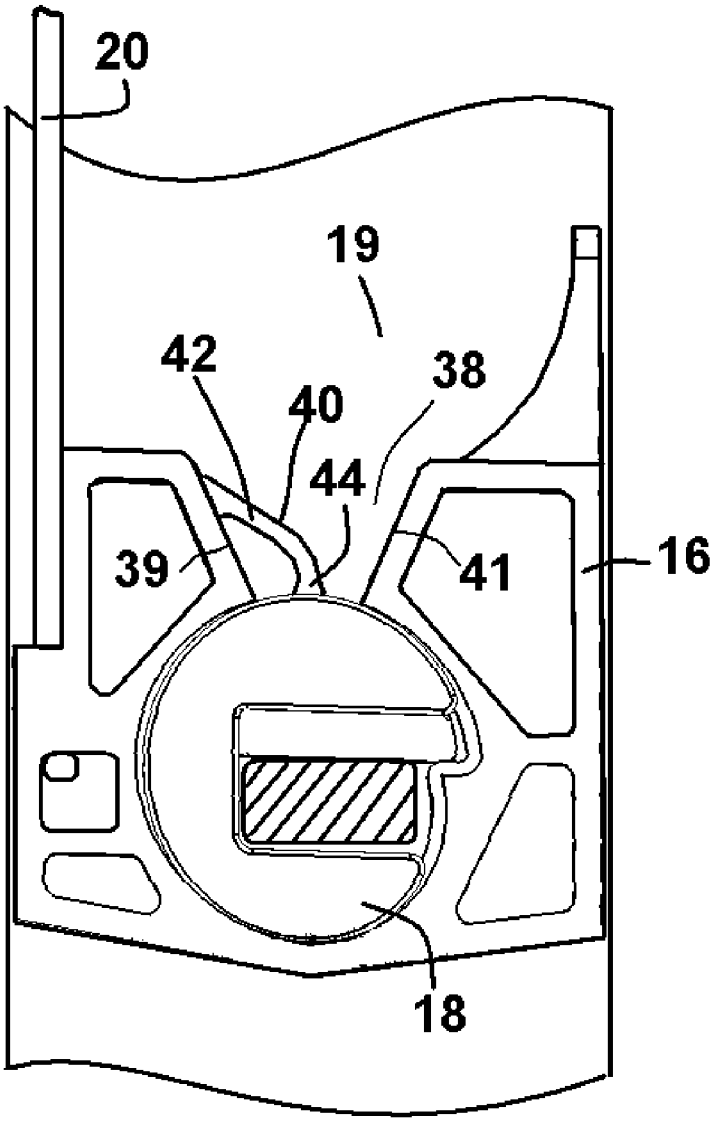
FIG. 2 is a cross section of the embodiment of the counterbalance system shown in FIG. 1, viewed along line 2-2.

Referring to FIG. 1, in conjunction with FIG. 2, there is shown an exemplary embodiment of a counterbalance system 10 that is used to counterbalance the sashes 12 contained within a window assembly 14. The counterbalance system 10 utilizes a brake shoe housing 16, a cam element 18, and at least one coil spring 20 on either side of each window sash 12. The brake shoe housing 16 engages a tilt post 22 that extends from the bottom of the window sash 12. As the window sash 12 is opened and closed, the brake shoe housing 16 travels up and down in vertical guide tracks 24. It will be understood that each window sash 12 typically utilizes two counterbalance systems on opposite sides of the sash 12. However, for the sake of simplicity and clarity, only one counterbalance system 10 is illustrated.

The brake shoe housing 16 receives the cam element 18 to form a brake shoe assembly 19. The brake shoe assembly 19 rides up and down in its guide track 24. The brake shoe assembly 19 is biased upwardly within the guide track 24 by at least one coil spring 20. The guide track 24 has a rear wall 26 and two side walls 27, 28. The brake shoe assembly 19 is sized to be just narrow enough to fit between the side walls 27, 28 of the guide track 24 without causing excessive contact with the guide track 24 as the brake shoe assembly 19 moves up and down with the window sash 12.

Figure 3:
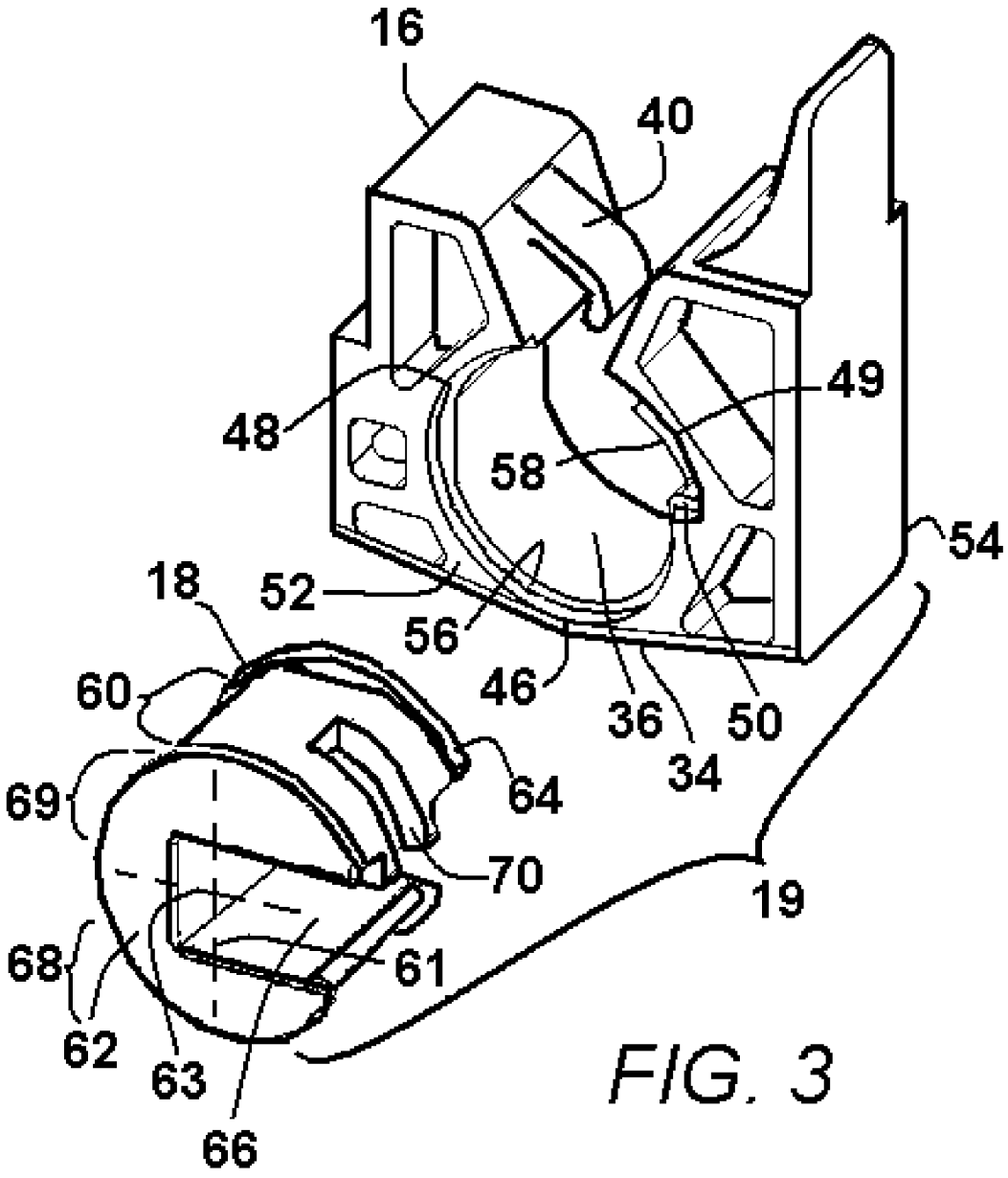
FIG. 3 is an exploded perspective view of the brake shoe housing and cam element of the counterbalance system.

Referring to FIG. 3 in conjunction with FIG. 1 and FIG. 2, it can be seen that the brake shoe housing 16 is a unistructurally molded unit that requires no assembly. The brake shoe housing 16 is generally U-shaped, having a first arm element 30 and a second arm element 32 that are interconnected by a thin bottom section 34. In the shown embodiment, the coil spring 20 attaches to the first arm element 30. In the preferred embodiment, the second arm element 32 has a length that is at least twenty-five percent longer than that of the first arm element.

A generally circular cam opening 36 is formed between the first arm element 30, the second arm element 32 and the bottom section 34. Above the cam opening 36, the first arm element 30 and the second arm element 32 are separated by a gap space 38. The first arm element 30 has a first sloped surface 39 that faces the gap space 38. Likewise, the second arm element 32 has a second sloped surface 41 that faces the gap space 38. Taken together, the first sloped surface 39 and the second sloped surface 41 diverge away from each other as they ascend above the cam opening 36. The result is that the gap space 38 has tapered sides that lead into the cam opening 36.

A catch finger 40 protrudes from the first sloped surface 39 of the first arm element 30. The catch finger 40 extends into the gap space 38 between the first arm element 30 and the second arm element 32. The catch finger 40 is integrally molded as part of the first arm element 30 and the overall brake shoe housing 16. The catch finger 40 has a first section 42 that extends away from the first sloped surface 39 at an acute angle. This causes the catch finger 40 to extend in a downward direction. The catch finger 40 then curves into a nearly vertical orientation proximate its free end 44. The free end 44 is molded to be slightly bulbous in order to prevent the catch finger 40 from hanging up on the tilt post 22, as will later be explained.

The cam opening 36, although generally circular, is not round. Rather, the cam opening 36 has a rounded bottom section 46. On the first arm element 30, the rounded bottom section 46 transitions into a first curved section 48 that has a larger radius of curvature than the rounded bottom section 46. On the opposite second arm element 32, there is a second curved section 49 with the same general radius of curvature as the first curved 48 section. However, the second curved section 49 does not transition directly into the rounded bottom section 46. Rather, the second curved section 49 is offset from the rounded bottom section 46 with a flat ridge 50. The flat ridge 50 acts as a stop for the cam element 18, as will later be explained.

The brake shoe housing 16 has a face surface 52 and a rear surface 54. The cam opening 36 extends from the face surface 52 back to the rear surface 54. The dimensions of the cam opening 36 decrease just behind the face surface 52 and the rear surface 54 of the brake shoe housing 16. The decreases in dimensions create ledges 56 in the cam opening 36 just behind the face surface 52 and the rear surface 54. The ledges 56 are used to help retain the cam element 18, which will be later described in more detail.

A key projection 58 protrudes into the cam opening 36 from the second curved section 49. The key projection 58 is positioned approximately midway between the face surface 52 and the rear surface 54. Again, the key projection 58 is used to help retain the cam element 18, which will be later described in more detail.

The cam element 18 is generally cylindrical in shape. The cam element 18, however, does not have a circular cross-sectional profile. Rather, the cross-sectional profile of the cam element 18 is oblong, being mildly elliptical in its general shape. The cam element 18 has a midsection 60 positioned between a front flange 62 and a back flange 64. The midsection 60 of the cam element 18 has a long axis 61 and a short axis 63 when viewed in cross-section from either end. The front flange 62 and the back flange 64 are slightly larger than the midsection 60, therein providing the cam element 18 with a slight spool configuration.

A tilt post receiving slot 66 is formed in the cam element 18. The receiving slot 66 extends from the front flange 62 to the back flange 64. However, the receiving slot 66 is not symmetrically positioned. Rather, the receiving slot 66 is eccentrically positioned, so that the receiving slot 66 is closer to one side of the cam element 18 than to the other. For the purposes of this description, the side of the cam element 18 that contains most of the receiving slot 66 shall be referred to as the narrow side 68 of the cam element 18. Conversely, the side of the cam element 18 that does not retain much of the receiving slot 66 is referred to as the wide side 69 of the cam element 18.

A groove 70 is formed in the exterior of the midsection 60 of the cam element 18 in the wide side 69 of the cam element 18. The groove 70 is sized to receive the key projection 58 formed into the cam opening.

Figure 4:
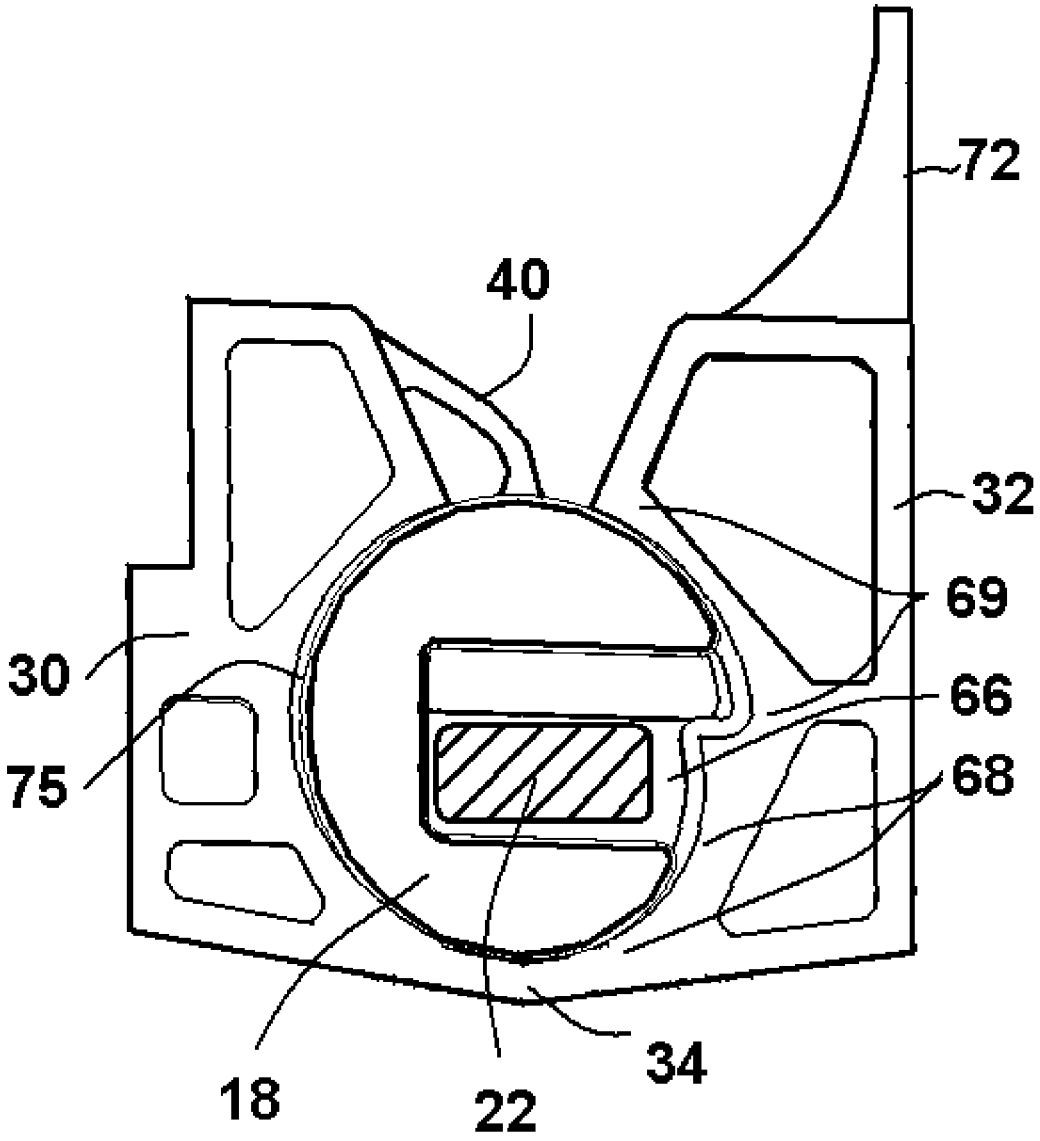
FIG. 4 is a front view of the brake shoe housing and cam element shown with the cam element holding a tilt post of a vertically oriented window sash.

Referring to FIG. 4, in conjunction with FIG. 1 and FIG. 3, it can be seen that the cam opening 36 receives and retains the cam element 18. During manufacture in the factory, the cam element 18 is inserted into the cam opening 36 by forcing the cam element 18 into the gap space 38 between the first arm element 30 and the second arm element 32 of the brake shoe housing 16. When pressed into the gap space 38, the cam element 18 spreads the first arm element 30 and the second arm element 32 apart. This is achieved by the elastic flexing of the thin bottom section 34 of the brake shoe housing 16, which acts as a living hinge. The cam element 18 also elastically deforms the catch finger 40 down until the cam element 18 passes. Once the cam element 18 is inside the cam opening 36, the first arm element 30 and the second arm element 32 rebound to their original positions. Likewise, the catch finger 40 returns to its original orientation. The presence of the catch finger 40 helps hinder the removal of the cam element 18 from the cam opening 36.

Once the cam element 18 is displaced into the cam opening 36 of the brake shoe housing 16, the front flange 62 and the back flange 64 of the cam element 18 engage the ledges 56 inside the cam opening 36 and prevent the cam element 18 from exiting the cam opening 36 either through the face surface 52 of the brake shoe housing 16 or the rear surface 54 of the brake shoe housing 16. Furthermore, the key projection 58 in the cam opening 36 engages the groove 70 of the cam element 18. This interconnection helps retain the cam element 18 in place, while still enabling the cam element 18 to rotate within the cam opening 36. The length of the groove 70 and the presence of the flat ridge 50 within the cam opening 36 limit the range of rotation achievable by the cam element 18 in the cam opening 36. In this manner, the over-rotation of the cam element 18 can be prevented.

The narrow side 68 of the cam element 18 is positioned toward the bottom of the brake shoe housing 16. This causes the tilt post receiving slot 66 to lie close to the thin bottom section 34 of the brake shoe housing 16. The tilt post receiving slot 66 receives the tilt post 22. Consequently, the tilt post 22 of the window sash 12 is held close to the thin bottom section 34 of the brake shoe housing 16. The result is that the window sash 12 can move to a lower position in the window frame than prior art brake shoe assemblies that support tilt posts in a cam near the center of the brake shoe housing.

Figure 5:
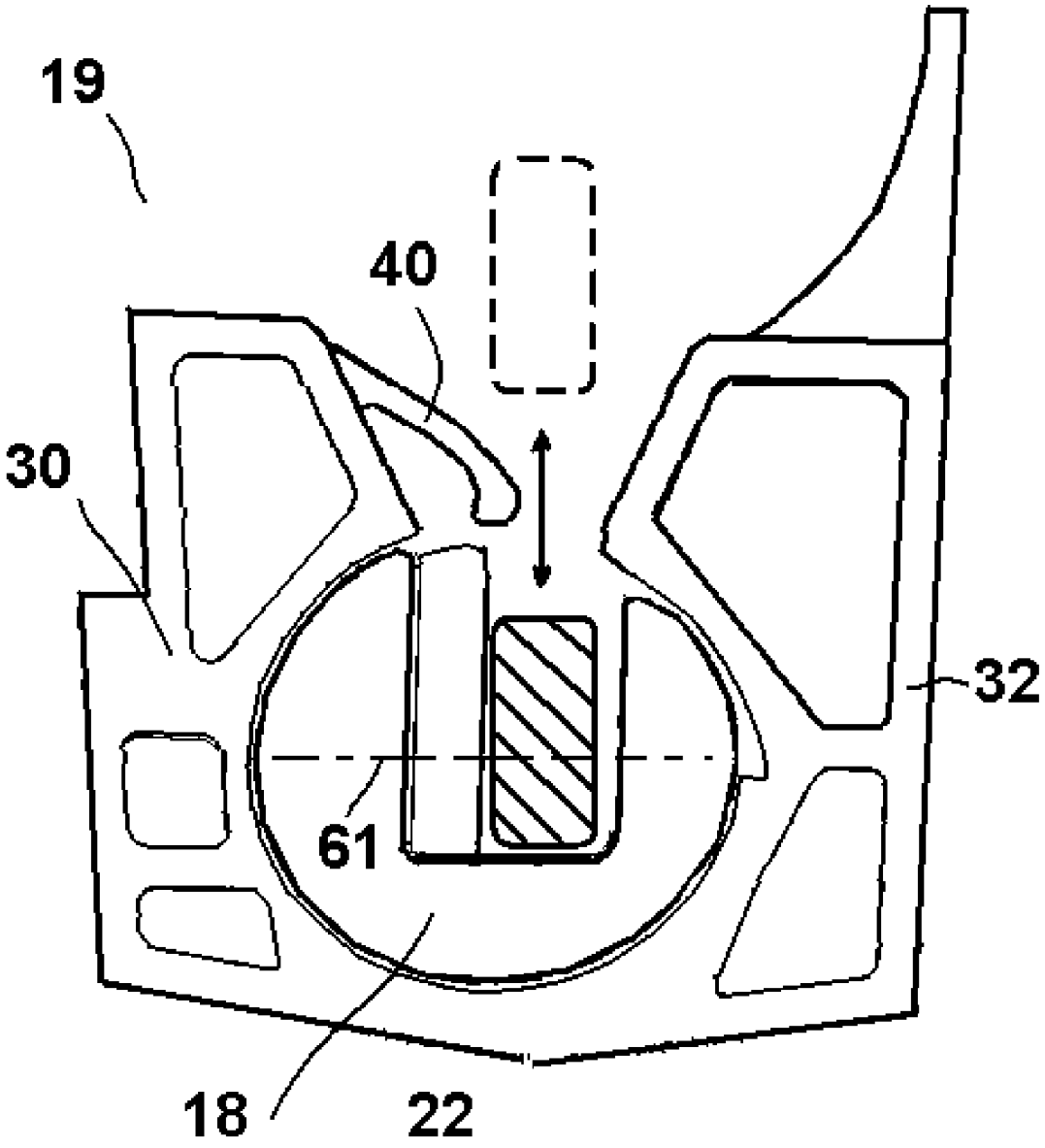
FIG. 5 is a front view of the brake shoe housing and cam element shown with the cam element holding a tilt post of a tilted window sash.

Referring to FIG. 5 in conjunction with FIGS. 1-4, it can be seen that when the window sash 12 is tilted inwardly, the tilt posts 22 of the window sash 12 causes the cam element 18 to turn. Prior, the long axis 61 of the cam element 18 had been vertically oriented. When the window sash 12 is tilted, that orientation changes toward the horizontal. The cam element 18 is oblong in shape since it has a long axis 61 and short axis 63. Consequently, when the cam element 18 turns, the cam element 18 spreads the first arm element 30 from the second arm element 32 of the brake shoe housing 16. As the cam element 18 spreads the brake shoe housing 16, the brake shoe housing 16 flexes in its bottom section 34. The first arm element 30 and the second arm element 32 engage the side walls 27, 28 of the track 24. The result is that the brake shoe assembly 19 becomes locked in position within the guide track 24.

As the cam element 18 spreads open the brake shoe housing 16, the gap space 38 between the first arm element 30 and the second arm element 32 increases. The tilt post 22 can therefore be removed from the cam element 18 through the widened gap space 38. Removal of the cam element 18 in such a manner is hindered by the presence of the catch finger 40. The catch finger 40 extends into the gap space 38 and provides a physical barrier that prevents the tilt post 22 from exiting the cam element 18. In this manner, the catch finger 40 prevents a user from inadvertently pulling the tilt post 22 out of the cam element 18 while tilting the window sash 12 inwardly.

It will be understood that if the window sash 12 is broken or otherwise is intended to be removed from the window assembly, such a removal is possible. A person intending to remove the window sash 12 can simply depress the catch finger 40 while pulling up on the window sash 12. If the catch finger 40 is depressed, it will not block the gap space 38 above the tilt post 22 and the tilt post 22 can be freely removed.

Alternately, since the receiving slot 66 that retains the tilt post 22 is eccentrically positioned toward the narrow side 68 of the cam element 18, it will be understood that the catch finger 40 will not align directly above the tilt post 22. Rather, as is shown in FIG. 5, the enlarged free end 44 of the catch finger 40 aligns above one side of the tilt post 22. This enables the catch finger 40 to prevent most accidental removals of the tilt post 22. However, if the window sash 12 is pulled upwardly with a sufficient and determined force, the tilt post 22 will contact the catch finger 40 at an angle. Provided the upward force exceeds a predetermined threshold force of at least five pounds, for example, the catch finger 40 will then elastically yield to the tilt post 22 and the window sash 12 can be removed. Once the window sash 12 is removed, the temporarily displaced catch finger 40 will return to its original position. In this manner, a serviceman or homeowner can intentionally pull the window sash 12 out of the window assembly without any tools or manual brake shoe manipulations. The requirement of sufficient and sustained force required for the removal eliminates most all inadvertent removals of the window sash 12.

FIGS. 2 and 4 show the brake shoe housing 16, cam element 18 and tilt post 22 when the window sash 12 is vertical and in its regular operating position. FIG. 5 shows the brake shoe housing 16, cam element 18 and tilt post 22 when the window sash 12 is tilted and the brake shoe housing 16 is locked in the guide track 24. The shape of the cam opening 36 varies between the regular operating position of FIG. 4 and the locked position of FIG. 5. As can be seen from FIG. 4 and FIG. 5, the shape of the cam element 18 is designed to more precisely fit the cam opening 36 when the cam opening 36 is in its locked position. The result is fewer gaps 75 where no contact exists. In this manner, the cam opening 36 better engages the brake shoe housing 16 and is more resistant to accidental replacement while the window sash 12 is being tilted in. This helps prevent the cam element 18 from being advertently pulled, pushed or otherwise displaced from the brake shoe housing 16.

In the shown embodiment, the coil spring 20 attaches to the first arm element 30 of the brake shoe housing 16. This causes the brake shoe housing 16 to have a rotational bias in the clockwise direction as it travels up and down the guide track 24. To prevent the brake shoe housing 16 from cocking in the guide track 24, the second arm element 32 is provided with an extension 72. The extension 72 elongates the second arm element 32 and provides more surface contact with the side walls 27, 28 of the window guide track 24. This extended contact prevents the brake shoe assembly 19 from cocking to the bias of the coil spring 20 and binding in the guide track 24.

Figure 6:
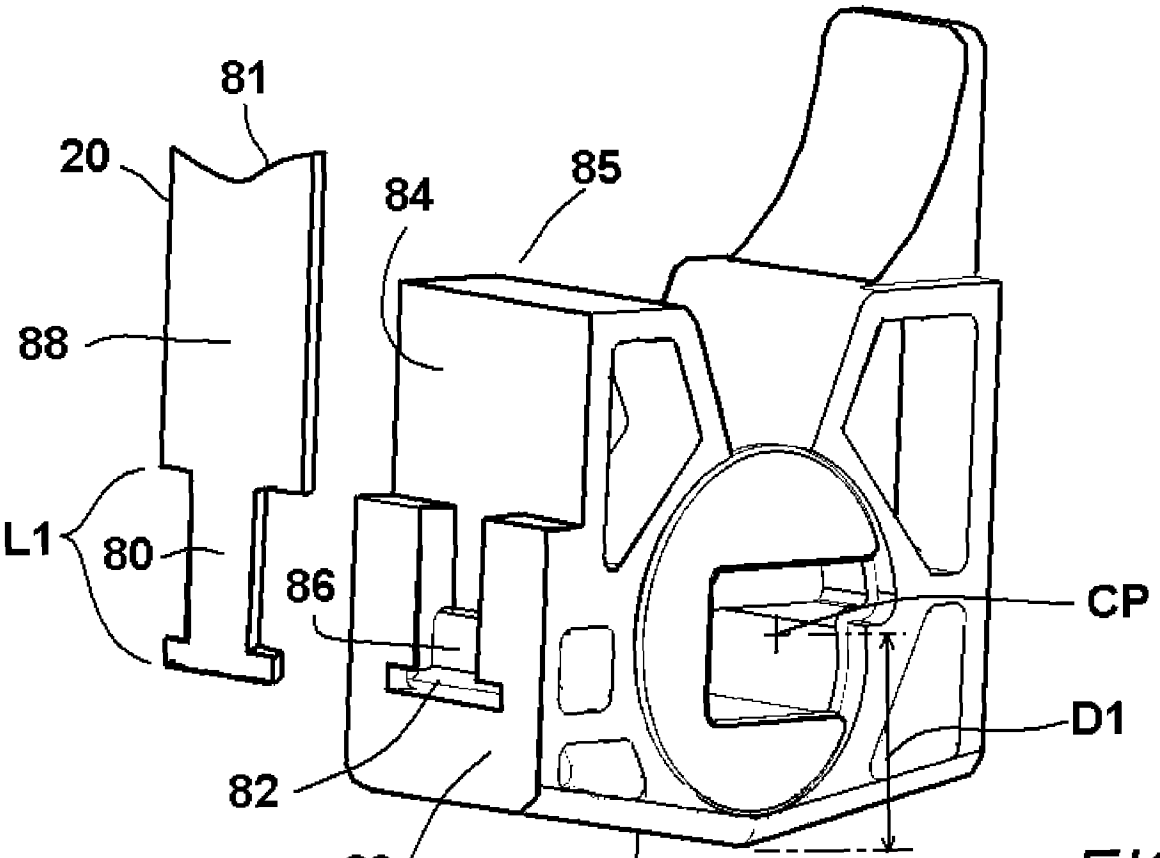
FIG. 6 is a perspective view of the brake shoe assembly and the free end of the coil spring to show interconnection features.
Figure 7:
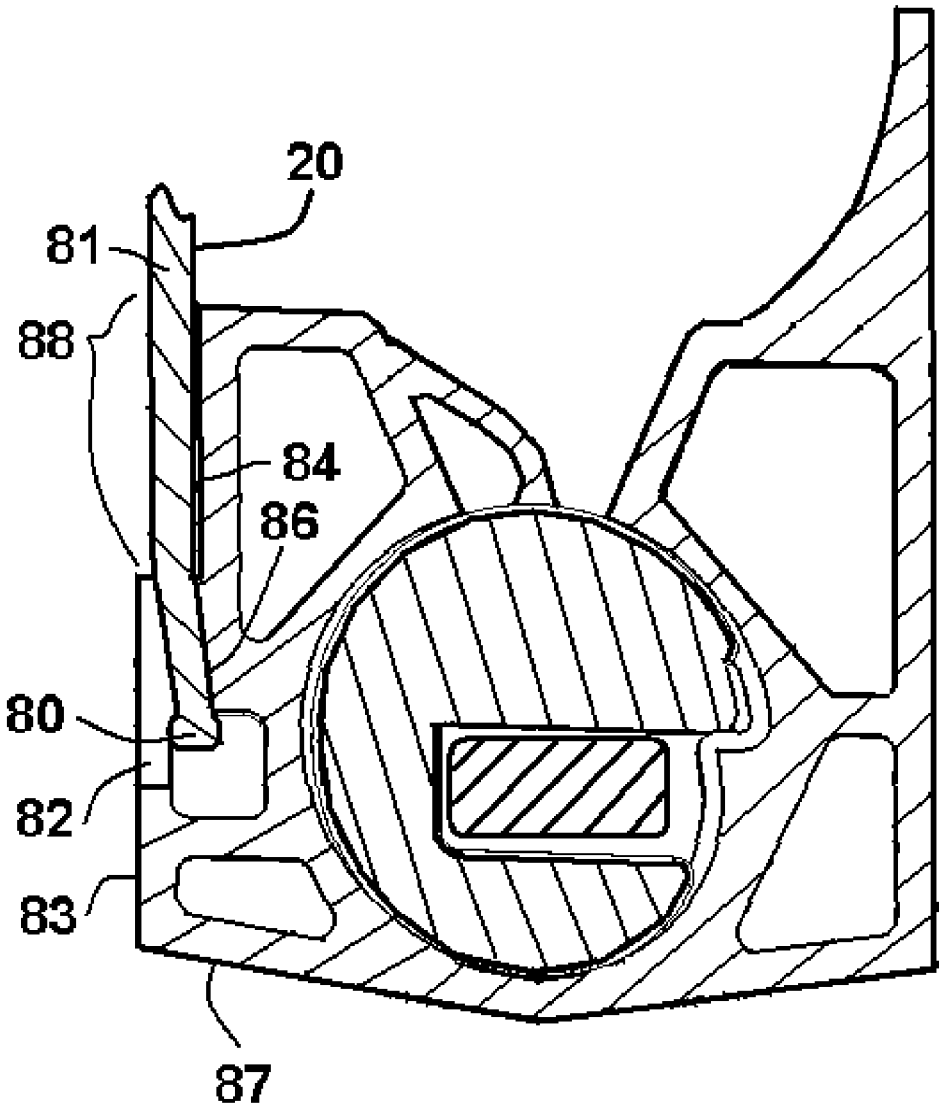
FIG. 7 is a cross-sectional view of the subassembly of FIG. 6.

Referring to FIG. 6 and FIG. 7, it can be seen that the coil spring 20 is made of a wound ribbon 81 of steel. The free end of the ribbon 81 is shaped into a T-shaped head 80 that is more narrow than the ribbon 81. The T-shaped head has a length L1. The T-shaped head 80 interconnects with the first arm element 30 of the brake shoe housing 16. The first arm element 30 of the brake shoe housing 16 is specially designed to receive both the T-shaped head 80 of the coil spring 20 and a length of the ribbon 81 proximate the T-shaped head 80 so as to reduce fatigue stresses in the coil spring 20.

A receptacle slot 82 is formed in a side wall 83 of the first arm element 30. The receptacle slot 82 is sized to receive and retain the T-shaped head 80 of the coil spring 20. A relief area 84 is formed in the side wall 83 of the first arm element 30 just above the receptacle slot 82. The receptacle slot 82 has a transition section 86 that smoothly leads the receptacle slot 82 into the relief area 84. When the coil spring 20 is engaged with the brake shoe housing 16, the T-shaped head 80 of the coil spring 20 enters the receptacle slot 82, therein mechanically interconnecting the coil spring 20 with the brake shoe housing 16. Once in this position, a length of the ribbon 81 proximate the T-shaped head 80 lays flush in the relief area 84. The length of the ribbon 81 supported by the relief area 84 is preferably at least as long as the length L1 of the T-shaped head 80. As a consequence, the receptacle slot 82 and the relief area 84 combine to form an anchor structure 85 that engages both the T-shaped head 80 of the coil spring 20 and the length of ribbon 81 behind the T-shaped head 80.

The T-shaped head 80 of the coil spring 20 is much narrower than the remaining ribbon 81 of the coil spring 20. As such, as a window sash 12 (FIG. 1) is opened and closed, changing tension forces and even some compression forces can be experienced by the coil spring 20. These changing forces create stresses that tend to concentrate in the thin T-shaped head 80 of the coil spring 20. The stresses fatigue the metal of the coil spring 20 and can eventually cause the T-shaped head 80 to break. By supporting both the T-shaped head and the segment of ribbon 81 behind the T-shaped head 80, the stress forces are prevented from concentrating in the T-shaped head 80. The result is that the coil spring 88 does experiences far less fatigue forces and therefore has a much longer operating life.

In order to accommodate both the receptacle slot 82 and the relief area 84, the receptacle slot 82 must be positioned low on the side wall 83 of the first arm element 30. The brake shoe housing 16 has a bottom surface 87 at the bottom of the bottom section 34. The cam opening 36 in the brake shoe housing 16 has a center point CP a predetermined distance D1 above the bottom surface 87. The receptacle slot 82 is positioned on the first arm element 30 at a height above the bottom surface 87 that is no higher than that of the center point CP of the cam opening 36.

Attaching the coil spring 20 to the brake shoe housing 16 at this low point of attachment has secondary advantages. The T-shaped head 80 of the coil spring 20 is generally horizontally aligned with the center of the cam element 18. Since the brake shoe housing 16 can rotate relative the cam element 18, this horizontal alignment minimizes the rotational torque experienced by the brake shoe housing 16. As a result, the cocking forces on the brake shoe housing 16 are minimized.

It will be understood that the embodiment of the present invention counterbalance system that is described and illustrated herein is merely exemplary and a person skilled in the art can make many variations to the embodiment shown without departing from the scope of the present invention. All such variations, modifications, and alternate embodiments are intended to be included within the scope of the present invention as defined by the appended claims.

What is claimed is:

1. An assembly for use in a counterbalance system of a tilt-in window, said assembly comprising:

a coil spring of ribbon having a free end, wherein said ribbon terminates with a shaped head proximate said free end, and wherein said shaped head extends a first length along said ribbon;

a brake shoe housing having a face surface, a rear surface, a bottom surface, a first side surface, and a second side surface, wherein said first side surface and said second side surface extend between said face surface and said rear surface at opposite sides of said brake shoe housing;

a cam opening disposed within said brake shoe housing, and wherein said cam opening has a center point a first distance above said bottom surface of said brake shoe housing;

a receptacle slot formed into said first side surface of said brake shoe housing at a distance from said bottom surface of said brake shoe housing no greater than said first distance, wherein said receptacle slot receives said shaped head of said coil spring; and a relief formed in said first side surface above said receptacle slot, said relief extending along said first side surface of said brake shoe housing for a second length that is at least as long as said first length, wherein a third length of said ribbon, adjacent said shaped head, extends through said relief and is supported by said first side surface as said shaped head is received within said receptacle slot, wherein said receptacle slot and said relief combine to form an anchor structure for said coil spring that engages both said shaped head and a section of ribbon adjacent the shaped head.

2. The assembly according to claim 1, wherein said shaped head includes a T-shaped termination.

3. The assembly according to claim 1, wherein said first side surface of said brake shoe housing is at least twenty-five percent shorter than said second side surface.

4. The assembly according to claim 1, wherein said brake shoe housing is integrally molded as a single piece of plastic.

5. An assembly for use in a counterbalance system of a tilt-in window, said assembly comprising:

a ribbon formed into a coil spring, said ribbon having a T-shaped termination proximate a free end, wherein said T-shaped termination extends a first length along said ribbon;

a brake shoe housing having a first side surface with a top edge, an opposite second side surface and a bottom surface that extends between said first side surface and said second side surface, wherein said second side surface is at least twenty-five percent longer than said first side surface;

a relief formed in said first side surface that extends partially down said first side surface from said top edge for a second length that is at least as long as said first length, wherein a third length of said ribbon, adjacent said T-shaped termination, extends through said relief and is supported by said first side surface;

a receptacle slot formed into said brake shoe housing below said relief, wherein said receptacle slot receives said T-shaped termination on said ribbon.

6. The assembly according to claim 5, wherein a cam opening is formed in said brake shoe housing, and wherein said cam opening has a center point a first distance above said bottom surface.

7. The assembly according to claim 6, wherein said receptacle slot is formed in said brake shoe housing at a position that is no further from said bottom surface than said first distance.

8. The assembly according to claim 5, wherein said brake shoe housing is integrally molded as a single piece of plastic.

9. An assembly for use in a counterbalance system of a tilt-in window, said assembly comprising:

a coil spring made of wound metal ribbon and terminated with a shaped head, wherein said shaped head extends along said metal ribbon for a first distance;

a brake shoe housing having a first side surface of a first length, an opposite second side surface of a second length, and a bottom surface that extends between said first side surface and said second side surface, wherein said second length of said second side surface is at least twenty-five percent longer than said first length of said first side surface, and wherein said first side surface defines an anchor structure for receiving and retaining all of said shaped head of said coil spring and supporting a portion of said metal ribbon proximate said shaped head, wherein said portion is at least as long as said first distance;

wherein said anchor structure includes a receptacle for receiving and retaining said shaped head of said coil spring;

wherein said anchor structure includes an open relief in said first side surface that supports said portion of said metal ribbon proximate said shaped head.

10. The assembly according to claim 9, wherein a cam opening is formed in said brake shoe housing, and wherein said cam opening has a center point a predetermined distance above said bottom surface.

11. The assembly according to claim 9, wherein said receptacle is formed in said brake shoe housing at a position that is said predetermined distance from said bottom surface.

* * * * *